US008528146B1

(12) United States Patent
Abrahamson

(10) Patent No.: US 8,528,146 B1
(45) Date of Patent: Sep. 10, 2013

(54) FLEXIBLE SWIMMING POOL BRUSH THAT CONTOURS TO CLEAN ALL ANGLES AND AREAS INSIDE OF POOLS

(71) Applicant: Edward Abrahamson, Las Vegas, NV (US)

(72) Inventor: Edward Abrahamson, Las Vegas, NV (US)

( * ) Notice: Subject to any disclaimer, the term of this patent is extended or adjusted under 35 U.S.C. 154(b) by 0 days.

(21) Appl. No.: 13/684,494

(22) Filed: Nov. 23, 2012

(51) Int. Cl.
*A46B 9/02* (2006.01)

(52) U.S. Cl.
USPC ..... 15/160; 15/201; 15/1.7

(58) Field of Classification Search
USPC ..... 15/160, 201, 146, 107, 104.04
See application file for complete search history.

(56) References Cited

U.S. PATENT DOCUMENTS 4,554,699 A * 11/1985 Simmons ..... 15/201
6,148,466 A * 11/2000 Smitelli et al. ..... 15/160
2009/0282633 A1* 11/2009 Fuller et al. ..... 15/160

* cited by examiner

*Primary Examiner* — Shay Karls
(74) *Attorney, Agent, or Firm* — Oakwood Law Group, LLP; Jie Tan

(57) ABSTRACT

The present invention discloses a cleaning apparatus which the main body is made up of individual brush sections that are shaped in such a way and attached to one another, that no matter which position it is in, always has a continuous row of bristles making contact with the surface being cleaned, and these sections are attached to each other using hinges, or hinge-like devices, and having constant tension that connects these sections, and allow each individual section to operate independently of one another, while always having the constant spring-like action of returning to a flat-like position when not being applied to contour to any angle or shape other than a flat surface, allowing the user to an easier, faster, and more efficient way to clean a swimming pool or other things alike.

8 Claims, 11 Drawing Sheets

FLEXIBLE SWIMMING POOL BRUSH THAT CONTOURS TO CLEAN ALL ANGLES AND AREAS INSIDE OF POOLS

REFERENCE TO RELATED APPLICATIONS

This patent application claims the benefit of U.S. Provisional Application No. 61/671,769 filed on Jul. 15, 2012, the disclosure of which is incorporated herein by reference in its entirety.

BACKGROUND OF THE INVENTION

Field of the Invention

The present invention relates to a cleaning apparatus and more particularly, to a cleaning apparatus for cleaning/brushing swimming pools or other things alike.

Cleaning devices for swimming pools or the like, such as swimming pool brushes, have been around for many years. Pool brushes typically incorporate and array of bristles with distal ends intended to follow the contour of the pool surface to provided for application of the solutions and dislodging of deposits and growth clinging to the surface. The conventional pool brushes are typically configured to follow a wide swath across the flat side or bottom wall of the pool. But modern pools often take numerous different shapes, thus have many of sharp or curved corners, ridges, crevices, risers and, depressions. These designs result in difficulties for using conventional pool brushes to clean the modern pools. Thus those working in the pool cleaning business have been left with the choice of either utilizing multiple brushes of different configurations for achieving the entire pool cleaning process or consuming inordinate time cleaning the large area surfaces with smaller specially contoured brushes or utilizing a larger area brush and leaving the contoured areas inadequately cleaned.

U.S. PreGrant Patent Publication No. 2009/0282633 to Fuller discloses a large area brush with a transversely projecting arcuate mounting bar and an array of generally radically projecting, discrete bristles which terminate at their distal extremities in working ends, evenly spaced to cooperate to form a flat plane that services as the working surface for the brush bristles. The laterally outwardly disposed discrete bristles are relatively long and will serve to, when compressed against a pool surface, flare laterally outwardly for cleaning of the curved surface.

U.S. Pat. No. 6,148,466 to Smitelli discloses a pool brush for cleaning narrow areas of pool such as corners and stairs, which has a brush head with a substantially cylindrical body and semi-spherical rounded ends. All the brush bristles are perpendicular to and uniformly mounted to the brush head. Each of the adjcent bristles on the rounded surfaces is angled from one another.

SUMMARY OF THE INVENTION

The primary objective of the present invention is to provide a simple, large area pool brush for easily cleaning swimming pools, regardless of the angle or shape of the pool. In an exemplary embodiment of the present invention, there is disclosed a cleaning apparatus which provides the means for cleaning/brushing a swimming pool or other things alike. Said cleaning apparatus comprises of:

i. a main body comprising a plurality of brush sections and each brush section comprising:

a) at least one brush head of bristles, b) at least one brush base which the bristles are attached to, and c) a channel shaped section holder that holds at least one brush base with brush head attached to, wherein each brush section can bend flexibly and independently to each other;

ii. a tension device that attaches to said main body;

iii. fasten means that connect each brush section to one another that makes up the main body;

iv. a shaft-like piece that is attached to the main body at one end and slides into an extension handle at the other end, said shaft-like piece further comprising a tension clip which locks the shaft-like piece into said extension handle.

By placing said apparatus up against the surface being cleaned or brushed, each brush section moves independently of one another, and automatically adjusts and contours to all the different shaped corners, edges, tight spots and even the vertical and horizontal parts of the steps/stairs, at the same time. No matter which position the sections of the cleaning apparatus are in, there is always a clean edge of brushes making contact with the surface. The apparatus will flex from the flat position all the way to a 90 degree angle, and everything in between. Said device can be made with a memory metal (spring steel) or out of other tension material options. Thus this apparatus will permit the user to easily and quickly clean/brush a swimming pool or things alike without having to move the apparatus around, in sometimes uncomfortable positions, and eliminating the having to make the many extra strokes required in tighter areas and corners, where the non-flexible brushes will not fit, or contour to.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 7 through FIG. 10 show various positions of the individual brush section or, of a group of brush sections in various different configurations and angles. They also flex to every position in between.

DESCRIPTION OF THE PREFERRED EMBODIMENT

The present invention discloses a cleaning apparatus which the main body is made up of individual brush sections that can bend flexibly and independently to one another.

Figure 1:
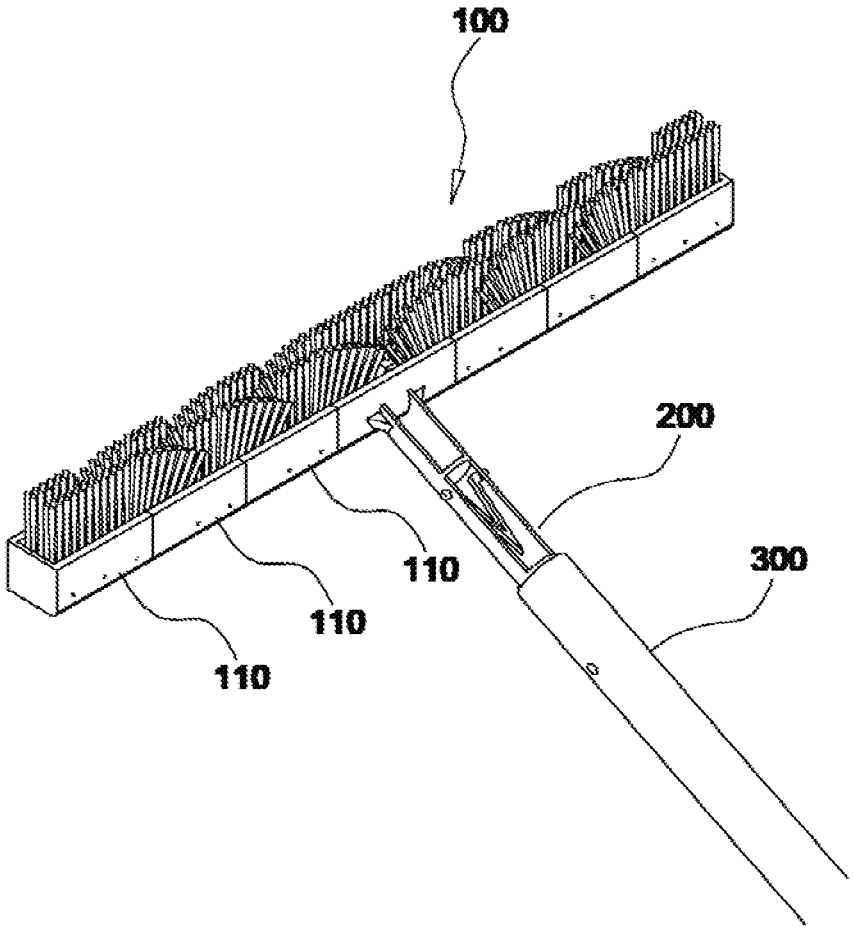
FIG. 1 shows the fully assembled cleaning apparatus of a preferred embodiment of present invention.

Referring to FIG. 1, there is disclosed a cleaning apparatus 10 comprises of a main body 100 and a shaft-like piece 200 that is attached to the main body 100 at one end and slides into an extension handle 300 at the other end. The main body is made up of individual brush sections 110 that can bend flexibly and independently to one another.

Figure 2:
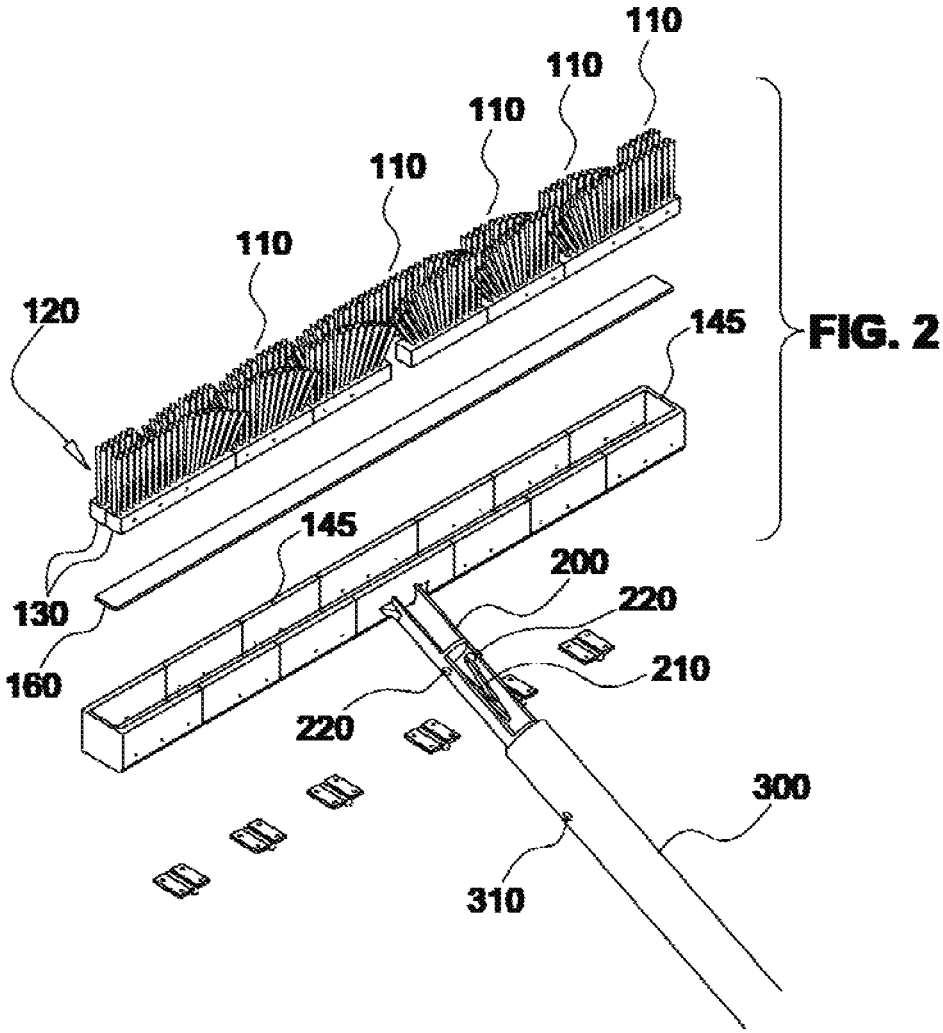
FIG. 2 is an explosive view of the fully assembled cleaning apparatus of a preferred embodiment of present invention.
Figure 3:
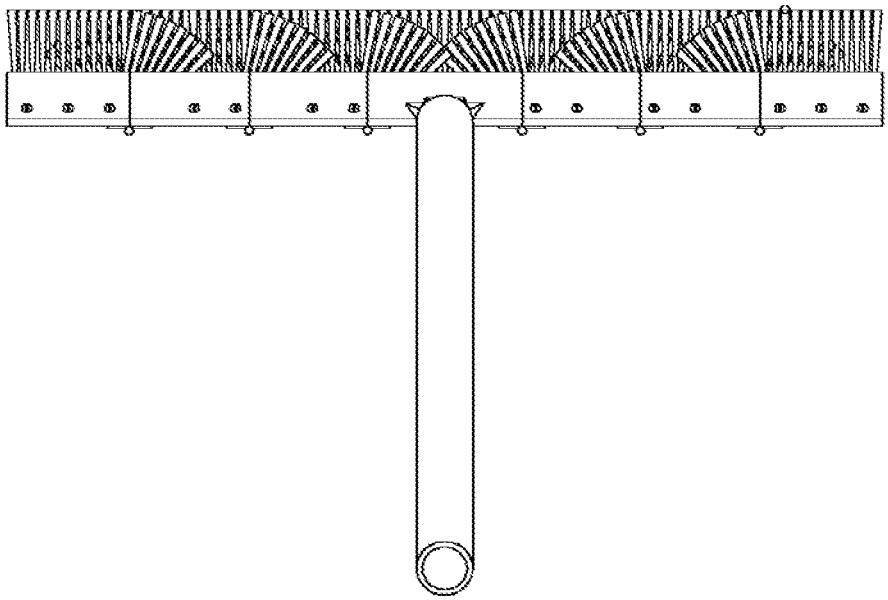
FIG. 3 shows the rear view of the fully assembled cleaning apparatus of a preferred embodiment of present invention.
Figure 4:
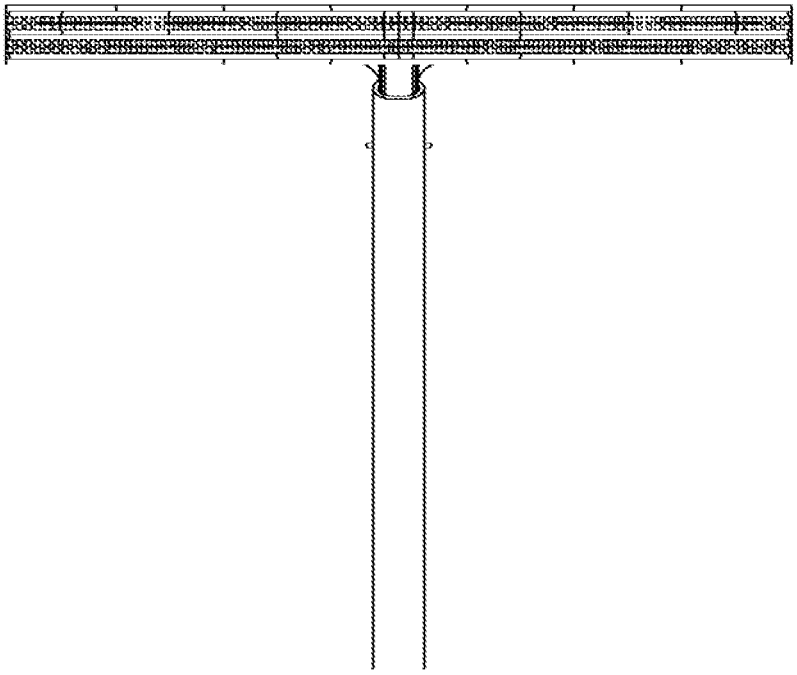
FIG. 4 shows the bottom view of the fully assembled cleaning apparatus of a preferred embodiment of present invention.
Figure 5:
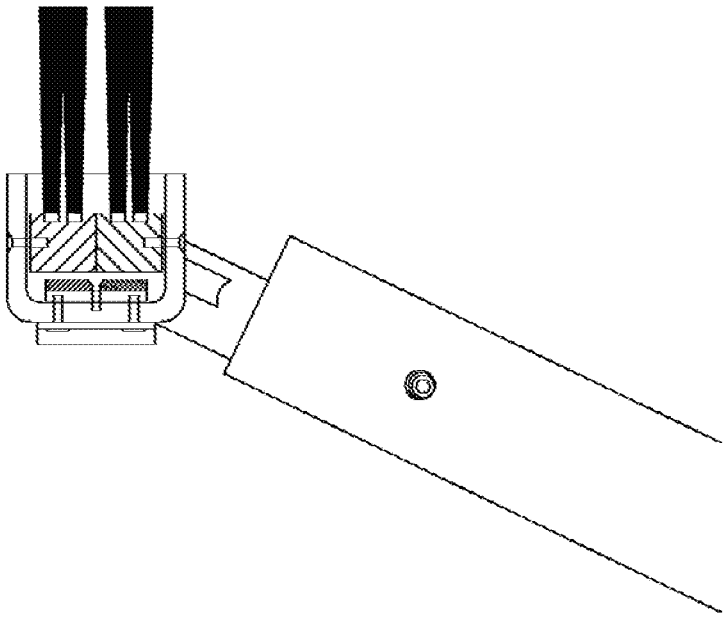
FIG. 5 shows the side view of the fully assembled cleaning apparatus of a preferred embodiment of present invention.
Figure 6:
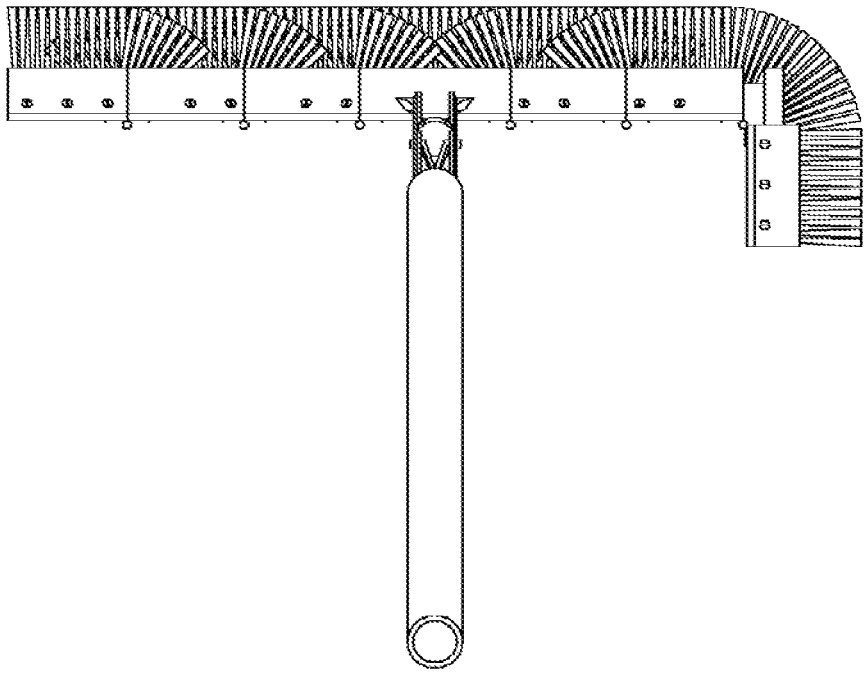
FIG. 6 shows one of the individual brush section in a 90 degree bend.
Figure 7:
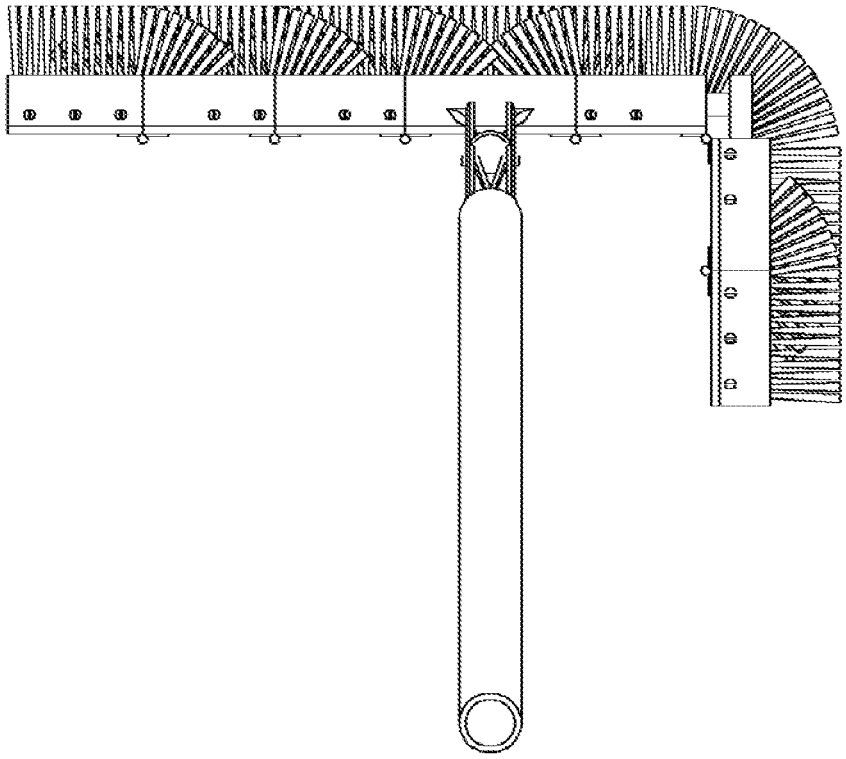
Figure 7A:
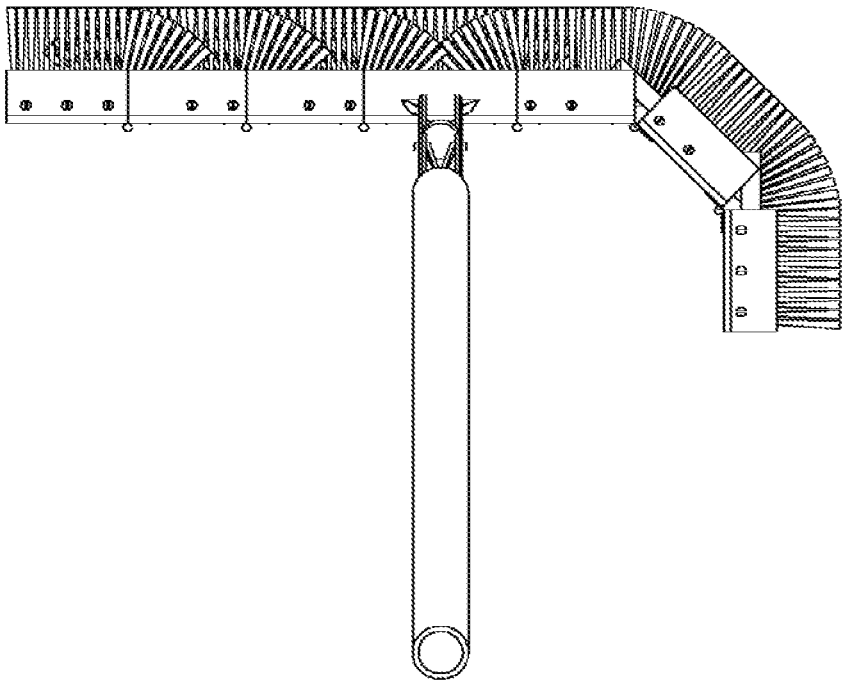
Figure 8:
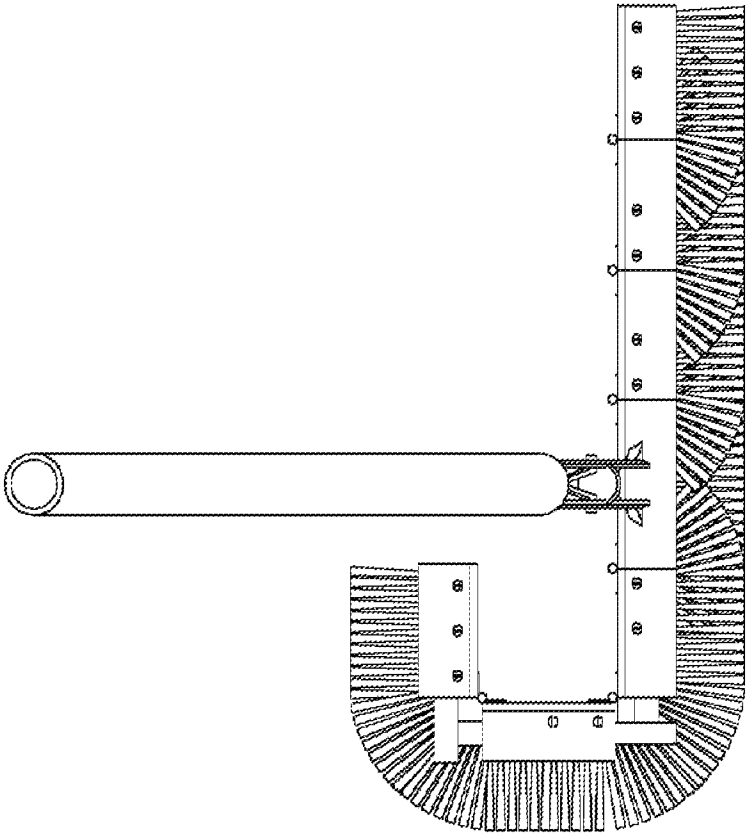
Figure 9:
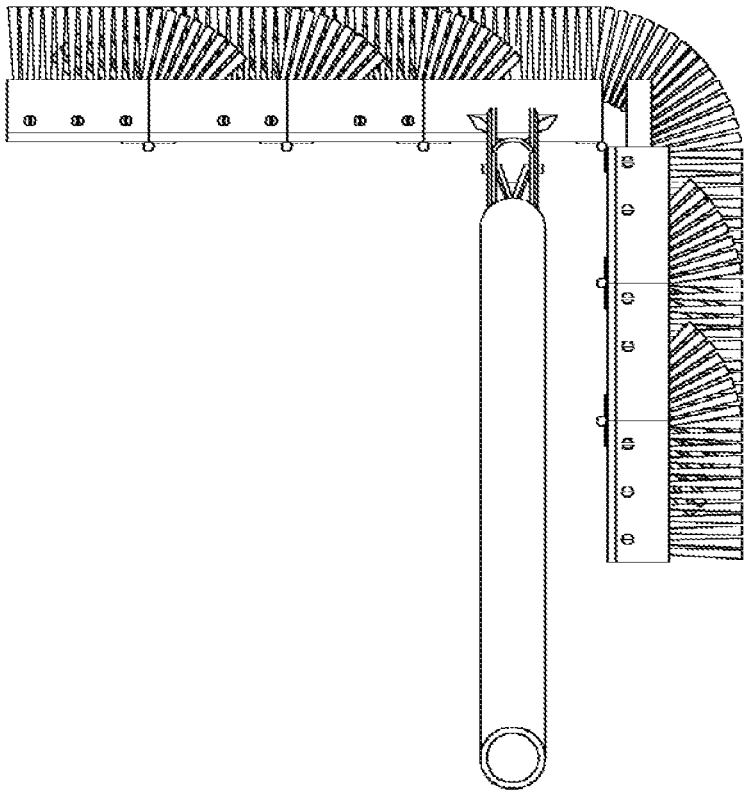

Referring to FIG. 2, each individual brush section 110 comprises of at least one brush head or bristles 120, at least one brush base 130. And the bristles 120 are attached to the brush base 130. The materials i for bristles may include, but not limited to, nylon, polypropylene, or metal wire, and the shape of the bristles may vary, for example, as indicated in FIG. 2. The brush section 110 also further comprises of channel shaped section holders 140, in which brush base 130 sits. The size and shape of the brush base matches and fits with the channel shaped section holder 140.

Figure 10:
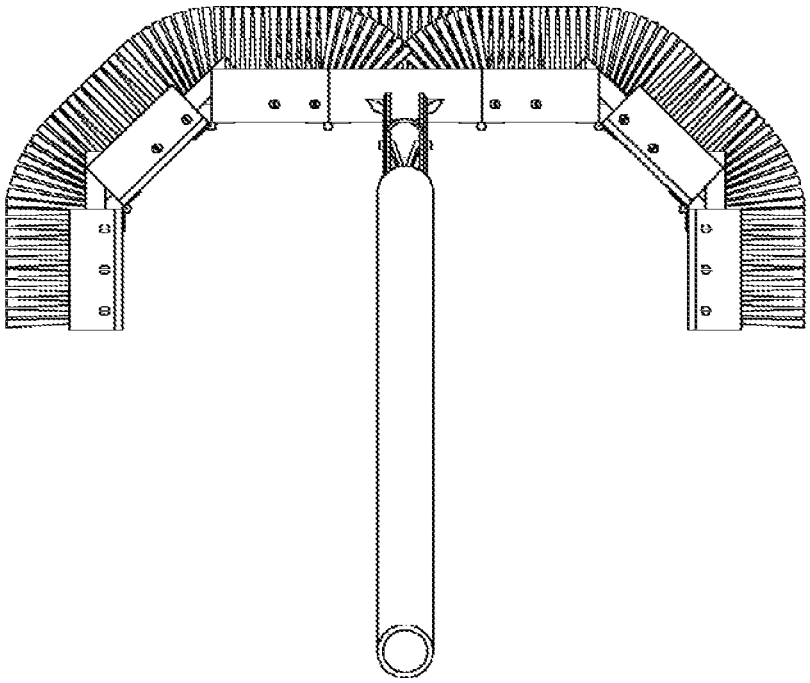

The main body 100 is made up of several individual brush sections that are connected via fasten means, as shown in FIG. 2, for example, via hinges 150, or as an example shown in FIG. 10, via spring hinges. In a preferred embodiment, each of the two end brush sections is capped 145. The main body 100 also further comprises of a tension device, as exampled as a tension strap 160 in FIG. 2 in one preferred embodiment, which runs through the length of the main body. The tension device may also be a spring hinge that attached to individual brush section, as shown in FIG. 10. The fasten means and tension device together make the each brush section of the main body may bend flexibly and independently, and also at the same time that allow the main body always has the constant spring-like action of returning to a flat-like position when not being applied to contour to any angle or shape other than a flat surface.

The shaft-like piece 200, that is attached to the main body 100 at one end and slides into an extension handle 300 at the other end, further comprises of a tension clip 210. There are two holes 220 at both sides of the shaft-like piece. When the shaft-like piece 200 slides into the extension handle 300, the tension clip expands and the two ends of the tension clip stick out through the holes to lock the shaft-like and extension handle together.

When the cleaning apparatus is applied against the surface being cleaned or brushed, each brush section moves independently of one another. Therefore, it can automatically adjusts and contours to all the different shaped corners, edges, tight spots and even the vertical and horizontal parts of the steps/stairs, at the same time. Each one brush section or a group of individual brush sections can bend from the flat position all the way to a 90 degree angle, and everything in between, as shown in FIG. 6 through FIG. 10. Thus this apparatus will permit the user to easily and quickly clean/brush a swimming pool or things alike without having to move the apparatus around, in sometimes uncomfortable positions, and eliminating the having to make the many extra strokes required in tighter areas and corners, where the non-flexible brushes will not fit, or contour to.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A cleaning apparatus comprising:

i. a main body comprising:

a plurality of brush heads of bristles, a plurality of brush bases which the bristles are attached to, a plurality of channel shaped sections that hold said plurality of brush bases with brush heads attached to, wherein each brush base can bend flexibly and independently to each other; and a tension device; and ii. a shaft-like piece that is attached to the main body at one end and slides into an extension handle at the other end, said shaft-like piece further comprising a tension clip which locks the shaft-like piece into said extension handle;

wherein said tension device is disposed between said each brush base and said each channel shaped section, said plurality of brush bases are independent of said plurality of channel shaped sections and said plurality of channel shaped sections are hinged with each other, an intersection between two channel shaped sections is cross-spanned with a brush base so that a bend between two channel shaped sections does not cause a space between two brush bases.

2. A cleaning apparatus of claim 1, wherein both outer end sections of said main body are capped.

3. A cleaning apparatus of claim 2, wherein said main body is made of materials including, but not limited to, PVC-like material, plastics, polymer, or various metals.

4. A cleaning apparatus of claim 2, wherein said bristles are made from materials including, but not limited to, nylon, polypropylene, or metal wire.

5. A cleaning apparatus of claim 2, wherein said tension device may be a tension strap, or different types of springs;

said tension device can be a single one that stretches across all of the brush sections, or each section can have an individual tension device.

6. A cleaning apparatus of claim 2, wherein said fasten means include hinges that connect each brush section, or a single body structure that runs the length of the main body and bends at certain intervals that allows each brush section the flexibility needed.

7. A cleaning apparatus of claim 2, further comprising plates that hold down said tension device on both ends of main body.

8. A cleaning apparatus of claim 2, wherein at both sides of said shaft-like piece there are two holes which allow said tension clip to expand and lock into position once inserted into said extension handle.

* * * * *